US007030825B1

(12) United States Patent
Fischer et al.

(10) Patent No.: US 7,030,825 B1
(45) Date of Patent: Apr. 18, 2006

(54) APERTURE ANTENNA ELEMENT

(75) Inventors: Georg Fischer, Bavaria (DE); Florian Pivit, Baden-Württember (DE)

(73) Assignee: Lucent Technologies Inc., Murray Hill, NJ (US)

( * ) Notice: Subject to any disclaimer, the term of this patent is extended or adjusted under 35 U.S.C. 154(b) by 65 days.

(21) Appl. No.: 10/954,033

(22) Filed: Sep. 29, 2004

(51) Int. Cl.
*H01Q 13/10* (2006.01)

(52) U.S. Cl. ..... 343/770

(58) Field of Classification Search ..... 343/770, 343/700 MS, 767, 756, 768, 881
See application file for complete search history.

(56) References Cited

U.S. PATENT DOCUMENTS

| | | | | |
|---|---|---|---|---|
| 5,025,264 | A * | 6/1991 | Stafford | 343/767 |
| 6,067,054 | A * | 5/2000 | Johannisson et al. | 343/816 |
| 6,456,241 | B1 | 9/2002 | Rothe et al. | 343/700 |
| 6,492,947 | B1 * | 12/2002 | Anderson | 343/700 MS |
| 2004/0130491 | A1 * | 7/2004 | Hayes | 343/701 |

FOREIGN PATENT DOCUMENTS

EP 0 445 453 7/1990

OTHER PUBLICATIONS

Haeng-Lyul Lee, et al., "Broadband Planar Antenna Having Round Corner Rectangular Wide Slot," *IEEE Antennas and Propagation Society International Symposium*, (Jun. 16-21, 2002), NY, NY, vol. 1 of 4, pp. 460-463.
European Search Report.

* cited by examiner

*Primary Examiner*—Wilson Lee
*Assistant Examiner*—Huedung X. Cao

(57) ABSTRACT

A wide-bandwidth aperture antenna is constructed of two parallel metal plates 51, 52, each having a resonant aperture 53, 54. The apertured plates are arranged parallel to one another, with the apertures aligned. A third plate 57 is arranged parallel to the apertured plates to act as a reflector. The resonant apertures are in the form of squares with rounded corners. Feed stubs 55 and 56 are arranged between the apertured plates and project into the region between the apertures to excite orthogonally polarized modes. The feed stubs are in the form of strips which are aligned in planes perpendicular to the planes of the apertured plates. An exemplary embodiment has a bandwidth of 1700 MHz to 3300 MHz, containing the bands used for GSM 1800, UMTS, UMTS+, Bluetooth and WLAN systems. The feed is high-impedance and the decoupling better than −11 dB over the whole bandwidth.

8 Claims, 3 Drawing Sheets

APERTURE ANTENNA ELEMENT

TECHNICAL FIELD

This invention relates to antennas, and particularly to wide-bandwidth aperture antennas.

BACKGROUND OF THE INVENTION

Wide-bandwidth antennas are desirable for a number of reasons. Firstly, they enable economies of scale in manufacture, since if an antenna can be used over a wide range of frequencies it will be applicable in more situations, so fewer different antenna designs will be required. Also, in the field of base stations for mobile telephone services, different standards are introduced from time to time, such as the UMTS standard, and these newly introduced standards do not immediately replace the existing ones, such as GSM, but have to co-exist with them. This means that base stations need to be able to operate according to more than one standard at once, and thus to operate in the different frequency bands demanded by the different standards. One possibility would be to have separate antennas for the different frequency bands, but that would add to the costs of the base stations. It would be preferable to have antennas which had a sufficiently wide bandwidth to accommodate the frequency bands of different standards.

SUMMARY OF THE INVENTION

According to the present invention there is provided an antenna including at least one conductive plate having a resonant aperture therein, said resonant aperture being in the form of a rectangle with rounded corners.

The antenna preferably comprises first and second said conductive plates having said resonant apertures therein, said first and second plates being parallel and said apertures being aligned, at least one feed stub between said first and second plates and extending into the space between said apertures and a third conductive plate, parallel to and spaced apart from said first and second plates.

BRIEF DESCRIPTION OF THE DRAWING

Some embodiments of the invention will now be described by way of example with reference to the accompanying drawings, in which.

DETAILED DESCRIPTION

Figure 1:
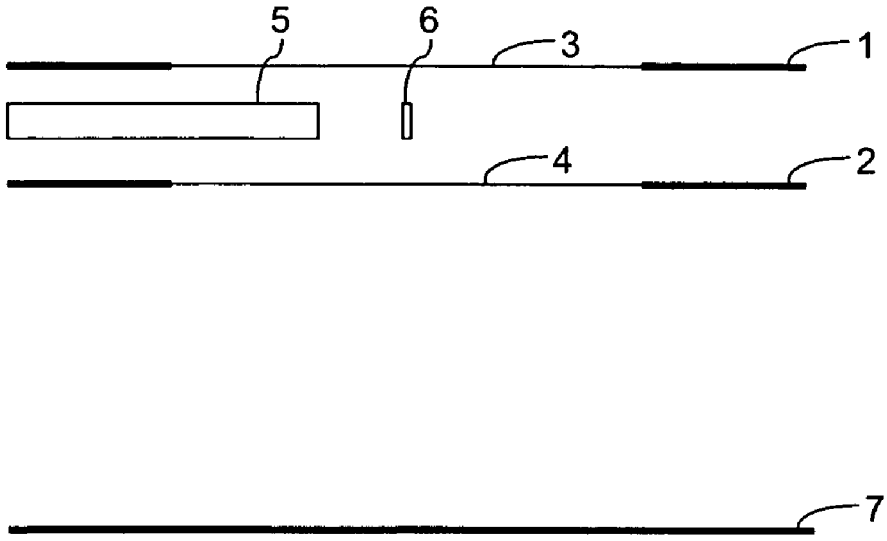
FIG. 1 shows a schematic side view of an antenna according to an embodiment of the invention.

FIG. 1 shows a side view of an antenna comprising a pair of apertured conductive plates 1 and 2, arranged parallel and adjacent to one another and having respective aligned apertures 3 and 4. Between the apertured plates 1 and 2 are a pair of feed stubs 5 and 6. The feed stubs 5 and 6 extend inwardly, extending part way into the region between the apertures 3 and 4. A third conductive plate 7 is parallel to and spaced apart from the apertured plates and acts as a reflector.

Figure 2:
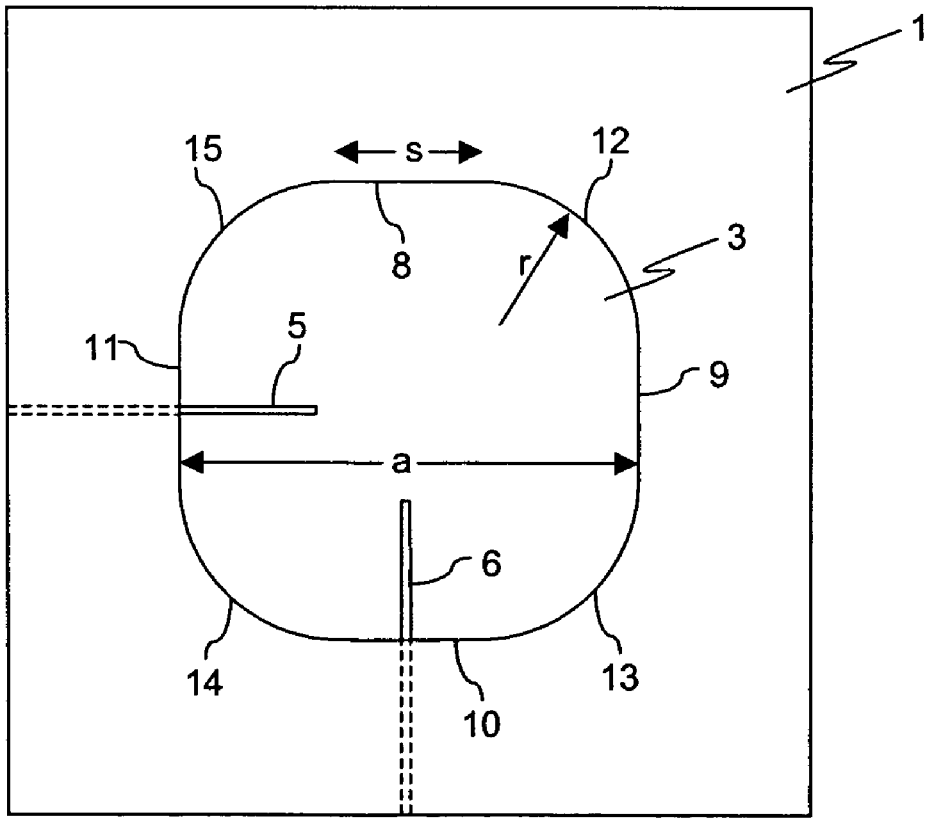
FIG. 2 shows a schematic top view of the antenna of FIG. 1.

FIG. 2 shows a top view of the antenna of FIG. 1, from which the shape of the aperture 3, which is identical to aperture 4, can be seen. Aperture 3 is in the form of a square with rounded corners. The boundary of aperture 3 consists of straight segments 8, 9, 10 and 11, of length s, forming parts of respective sides of a square of side a, joined by 90° circular arcs 12, 13, 14 and 15 of radius r. The ratio of r to a is preferably in the range 10% to 45%, more preferably in the range 20% to 40% and more preferably in the range 30% to 35%. In an embodiment to be described in more detail it is about ⅓.

We have found that such an aperture enables the antenna to have a wide bandwidth whilst, at the same time, providing good maintenance of polarization and good decoupling between the modes excited by the respective feed stubs.

As is shown most clearly in FIG. 2, the feed stubs 5 and 6 extend into the apertures at the centers of the straight segments 11 and 10 respectively, and at right angles to them. Thus, the feed stubs 5 and 6 are coupled to respective orthogonally polarized modes.

The conductive plates 1, 2 and 7 and the feed stubs 5 and 6 may be of sheet metal or of metal plated onto respective insulating substrates.

The feed stubs 5 and 6, as can be seen most clearly in FIG. 1 for feed stub 6, are thin conductive strips and, in contrast to feed stubs in conventional aperture antennas, have a vertical orientation. That is to say, there are oriented in planes which are perpendicular to the planes of the apertured plates 1 and 2, so that they present their thickness dimension, rather than their width dimension, to the apertured plates 1 and 2. This achieves a better coupling and reduces the disturbance of the field in the apertures.

Figure 3:
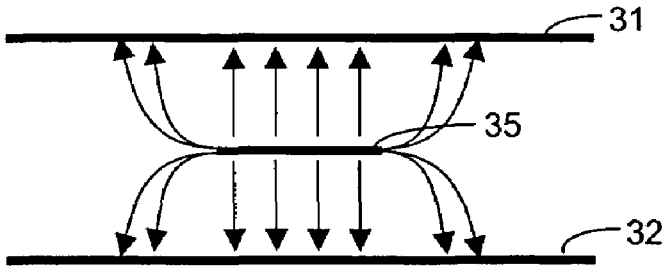
FIGS. 3 and 4 show schematic field distributions a known type of feed and the feed employed in the antenna of FIG. 1.
Figure 4:
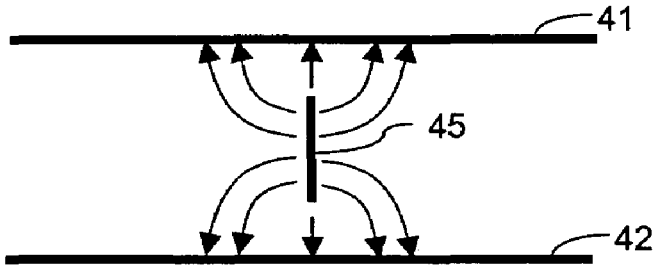

FIGS. 3 and 4 show electric field lines with, respectively, a conventional horizontally oriented feed stub 35 between apertured plates 31 and 32 as shown in FIG. 3 and a vertically oriented feed stub 45 between apertured plates 41 and 42 as shown in FIG. 4. Using the vertical orientation, as in the antenna of FIGS. 1 and 2, and in all of the embodiments to be described, it is possible to design the feed with a high impedance. In an example, to be described in more detail, the feeding line had an impedance of 100 Ω, which has the advantage that two antenna elements, or two feed stubs in one antenna element, can be fed in parallel from one conventional 50 Ω connection without the necessity for impedance matching networks, which would reduce the bandwidth of the configuration.

Figure 5:
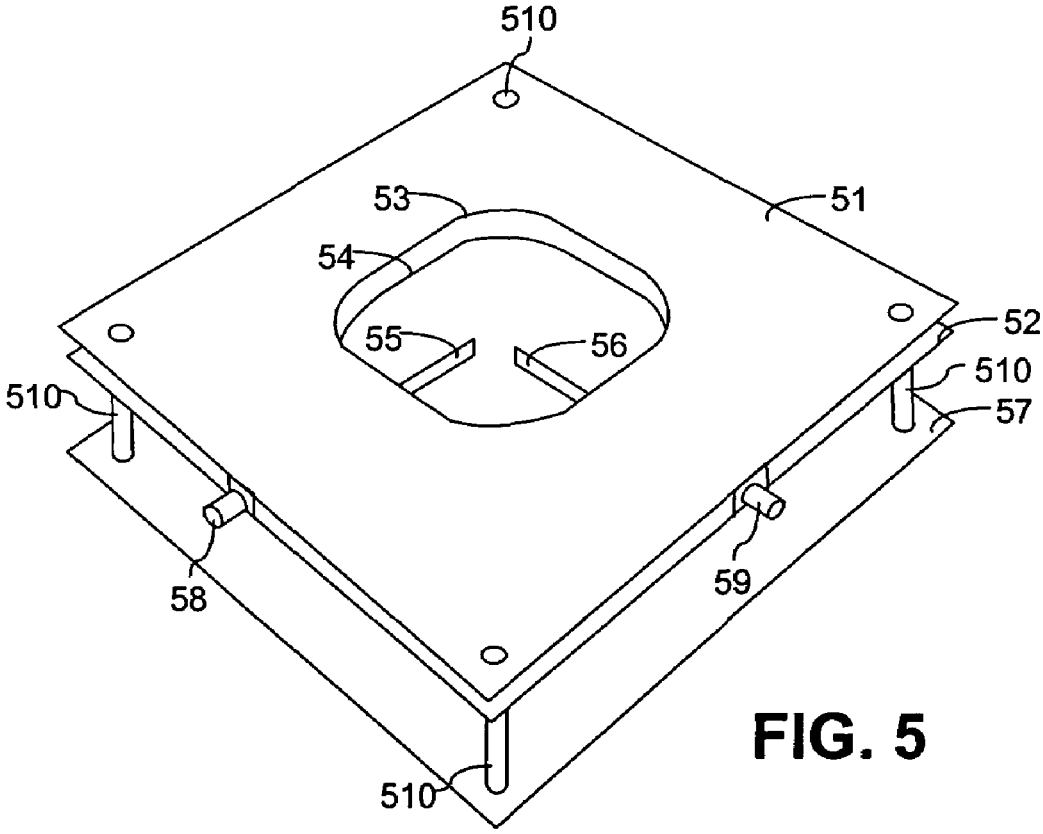
FIG. 5 shows a perspective view of an antenna according to an embodiment of the invention.

FIG. 5 shows an experimental single antenna element which operates in a frequency range of 1700 MHz to 3300 MHz, including the bands used in GSM 1800, UMTS, Bluetooth and WLAN systems. The first and second apertured plates 51 and 52, and the third plate 57 are constructed from 0.5 mm brass sheet metal and are held in their relative positions by brass posts 510 at the corners. The spacing between the apertured plates 51 and 52 is 12 mm and the third plate is spaced apart from the apertured plates by 40 mm.

The apertures 53 and 54 have an overall width a of 90 mm. The radius r of the circular arcs forming the rounded corners is 30 mm, so the length s of the straight segments of the aperture boundary is also 30 mm.

The feed stubs 55 and 56 are made from 1 mm thick sheet metal and have a width of 4 mm. They are vertically oriented, extend 32 mm into the aperture and, for the purposes of this experimental embodiment, are mounted directly on 50 Ω co-axial surface mounting (SMA) connectors 58 and 59 which are soldered to the apertured plates 51 and 52.

Figure 6:
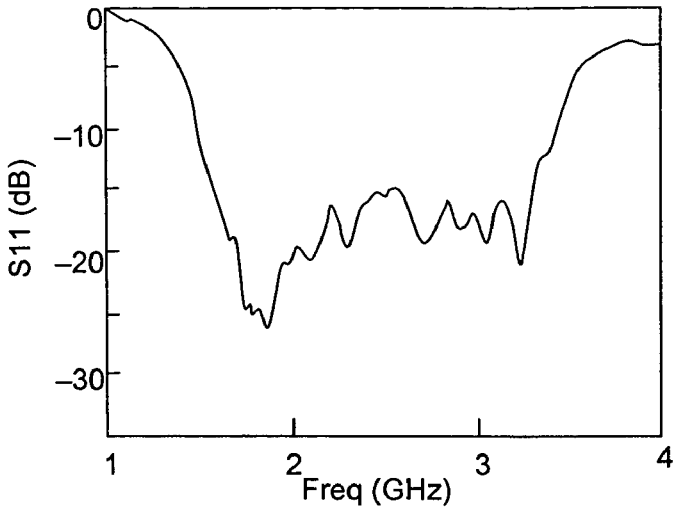
FIG. 6 shows the results of some experimental measurements taken on the antenna of FIG. 5.

We tested the antenna of FIG. 5 by measuring the input reflection coefficient with a 50 Ω network analyzer. This measurement result was then de-embedded by the length of the SMA connector and afterwards renormalized to 100 Ω. The results are shown in FIG. 6. The renormalized reflection coefficient is below −10 dB over the whole of the design frequency range. We also determined that the port decoupling was better than −11 dB over the whole bandwidth.

Figure 7:
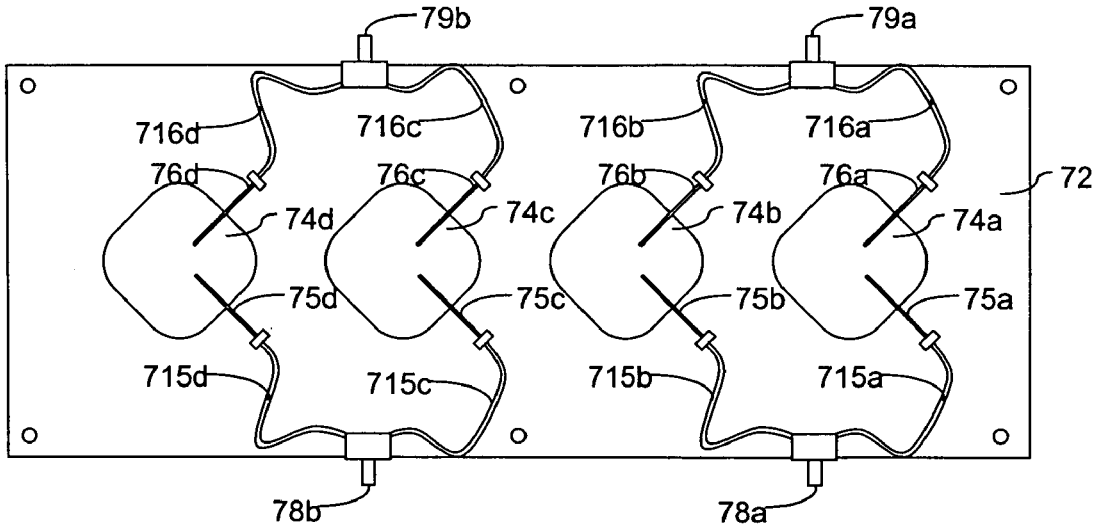
FIG. 7 shows a top view, with the top plate removed, of an antenna array according to an embodiment of the invention.

FIG. 7 shows an antenna array with four elements. The topmost (first) apertured plate has been removed to enable the feed arrangement to be seen. The second apertured plate 72 has four identical apertures 74*a*, 74*b*, 74*c* and 74*d* regularly spaced apart. Each of the apertures 74*a*, 74*b*, 74*c* and 74*d* has the shape and dimensions discussed above in connection with FIGS. 2 and 5. The first apertured plate, which is not shown, has identical apertures. Each of the apertures has a corresponding pair of feed stubs 75*a* and 76*a*, 75*b* and 76*b*, 75*c* and 76*c* and 75*d* and 76*d*, the stubs of each pair being arranged to excite orthogonally polarized modes in their respective aperture. Thus, the feed stubs 75*a*, 75*b*, 75*c* and 75*d* are arranged to excite one linear polarization in the respective apertures 74*a*, 74*b*, 74*c* and 74*d* and the feed stubs 76*a*, 76*b*, 76*c* and 76*d* are arranged to excite the orthogonal linear polarization in the respective apertures 74*a*, 74*b*, 74*c* and 74*d*. The feed stubs 75*a* and 75*b* are connected via respective co-axial leads 715*a* and 715*b* to a SMA co-axial connector 78*a*. Similarly, the feed stubs 75*c* and 75*d* are connected via respective co-axial leads 715*c* and 715*d* to a SMA co-axial connector 78*b*, the feed stubs 76*a* and 76*b* are connected via respective co-axial leads 716*a* and 716*b* to a SMA co-axial connector 79*a* and the feed stubs 76*c* and 76*d* are connected via respective co-axial leads 716*c* and 716*d* to a SMA co-axial connector 79*b*. The SMA co-axial connectors 78*a*, 78*b*, 79*a* and 79*b* form input/output ports for the antenna array.

In the antenna array of FIG. 7 all the co-axial leads 715 and 716 are the same length, so there is no built-in phase difference between the signals provided to the four antenna elements. Also, each of the SMA co-axial connectors is connected to two feed stubs arranged to excite parallel linear polarizations. For example, SMA connector 78*a* is connected to feed stubs 75*a* and 75*b*, which both excite parallel linear polarizations, whereas SMA connector 79*a* is connected to feed stubs 76*a* and 76*b*, which both excite parallel linear polarizations, orthogonal to those excited by feed stubs 75*a* and 75*b*. This means that the two linear polarizations can be excited independently, to employ polarization diversity, for example.

Figure 8:
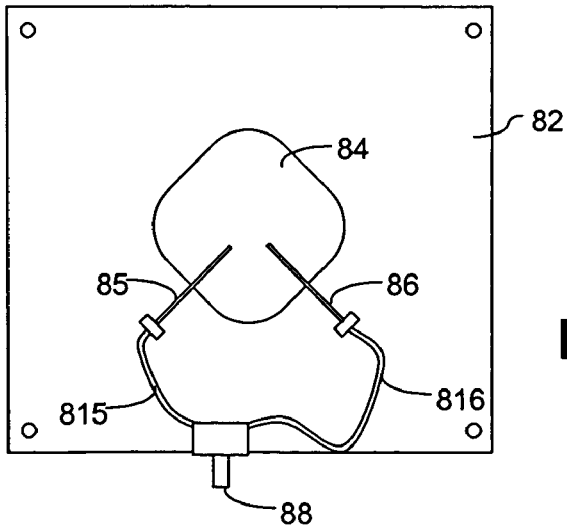
FIG. 8 shows a top view, with the top plate removed, of an antenna according to an embodiment of the invention arranged to operate with circularly polarized radiation.

FIG. 8 shows an alternative arrangement, in which a single SMA connector 88 is connected to feed stubs 85 and 86 arranged to excite orthogonally polarized modes in a single aperture 84. Furthermore, the feed stubs 85 and 86 are connected via co-axial leads 815 and 816 of different lengths. Thus, a signal applied to the SMA connector 88 will excite both polarizations, with a phase difference between them, due to the difference in length between the leads 815 and 816. Such an arrangement can be used to excite circular polarization.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

For example, in the embodiments described, the apertures are in the form of squares with rounded corners. The same principles would apply to apertures that were in the form of oblong rectangles with rounded corners. Such an antenna would have different frequency bands for the two linear polarizations.

We claim:

1. An antenna including at least one conductive plate having a resonant aperture therein, said resonant aperture being in the form of a rectangle with rounded corners the antenna comprising:

first and second said conductive plates having said resonant apertures therein, said first and second plates being parallel and said apertures being aligned;

at least one feed stub between said first and second plates and extending into the space between said apertures; and a third conductive plate, parallel to and spaced apart from said first and second plates, wherein each of said at least one feed stub is a thin conductive strip oriented in a plane which is perpendicular to the planes of said first and second plates.

2. The antenna of claim 1 wherein at least one of said apertures comprises a square with rounded corners.

3. The antenna of claim 2 wherein each of said apertures has a boundary consisting of four straight segments of length s, forming parts of respective sides of a square of side a, joined by 90° circular arcs of radius r.

4. The antenna of claim 3 wherein the ratio of r to a is about one third.

5. The antenna of claim 3 wherein each of said at least one feed stub extends into the space between said apertures at a position which is at the center of a respective one of said straight segments and in a direction which is perpendicular to said one of said straight segments.

6. The antenna of claim 5 having two said feed stubs at right angles to one another.

7. The antenna of claim 6 for use with circularly polarized radiation, wherein said two feed stubs are connected to a common input/output port via leads of different lengths.

8. The antenna of claim 1 wherein each of said first and second plates has a plurality of said apertures, each aperture in said first plate being aligned with a corresponding aperture in said second plate and each pair or corresponding apertures having a corresponding one or more feed stubs extending into the space between them.

* * * * *